US011433454B2

(12) United States Patent
Pederzoli

(10) Patent No.: US 11,433,454 B2
(45) Date of Patent: Sep. 6, 2022

(54) TRIMMING-DEBURRING ASSEMBLY

(71) Applicant: MECCANICA PI.ERRE S.R.L. DI PEDERZOLI RUGGERO & C., Bedizzole (IT)

(72) Inventor: Ruggero Pederzoli, Bedizzole (IT)

(73) Assignee: MECCANICA PI.ERRE S.R.L. DI PEDERZOLI RUGGERO & C., Bedizzole (IT)

( * ) Notice: Subject to any disclaimer, the term of this patent is extended or adjusted under 35 U.S.C. 154(b) by 68 days.

(21) Appl. No.: 16/973,469

(22) PCT Filed: Jun. 6, 2019

(86) PCT No.: PCT/IB2019/054724
§ 371 (c)(1),
(2) Date: Dec. 9, 2020

(87) PCT Pub. No.: WO2020/012264
PCT Pub. Date: Jan. 16, 2020

(65) Prior Publication Data

US 2021/0229168 A1 Jul. 29, 2021

(30) Foreign Application Priority Data

Jul. 10, 2018 (IT) ..... 102018000007057

(51) Int. Cl.
*B22D 31/00* (2006.01)

(52) U.S. Cl.
CPC ..... *B22D 31/002* (2013.01); *Y10T 83/8821* (2015.04)

(58) Field of Classification Search
CPC ..... B22D 31/002; Y10T 83/8821
See application file for complete search history.

(56) References Cited

U.S. PATENT DOCUMENTS

| | | | |
|---|---|---|---|
| 6,562,264 | B1 | 5/2003 | Taniguchi et al. |
| 2001/0026032 | A1 | 10/2001 | Okada |
| 2005/0147704 | A1 | 7/2005 | Ickinger et al. |

FOREIGN PATENT DOCUMENTS

| | | | |
|---|---|---|---|
| JP | 2003220638 | A | 8/2003 |
| JP | 2005059539 | A | 3/2005 |

OTHER PUBLICATIONS

International Search Report, issued in PCT/IB2019/054724, dated Aug. 16, 2019, Rijswijk, Netherlands.

*Primary Examiner* — Kevin P Kerns
*Assistant Examiner* — Steven S Ha
(74) *Attorney, Agent, or Firm* — ArentFox Schiff LLP; Michael Fainberg

(57) ABSTRACT

A trimming-deburring assembly includes an upper fixed plate, a lower fixed plate, an intermediate mobile plate, movable between the upper and lower fixed plates, in a vertical direction, and command and movement means for moving the intermediate mobile plate, having an electric motor and a movement group operatively connected on a top to the electric motor and on the bottom to the intermediate mobile plate. The movement group has a spindle member drivable in rotation by the electric motor, having a spindle cavity and a worm gear element provided with a worm gear cavity defined by a threaded worm gear wall, and a worm screw element at least partially housed in the spindle cavity and in the worm gear cavity, having a threaded screw wall engaged with the threaded worm gear wall to receive rotary action of the worm gear element, and a lower end operatively connected to the lower fixed plate.

19 Claims, 6 Drawing Sheets

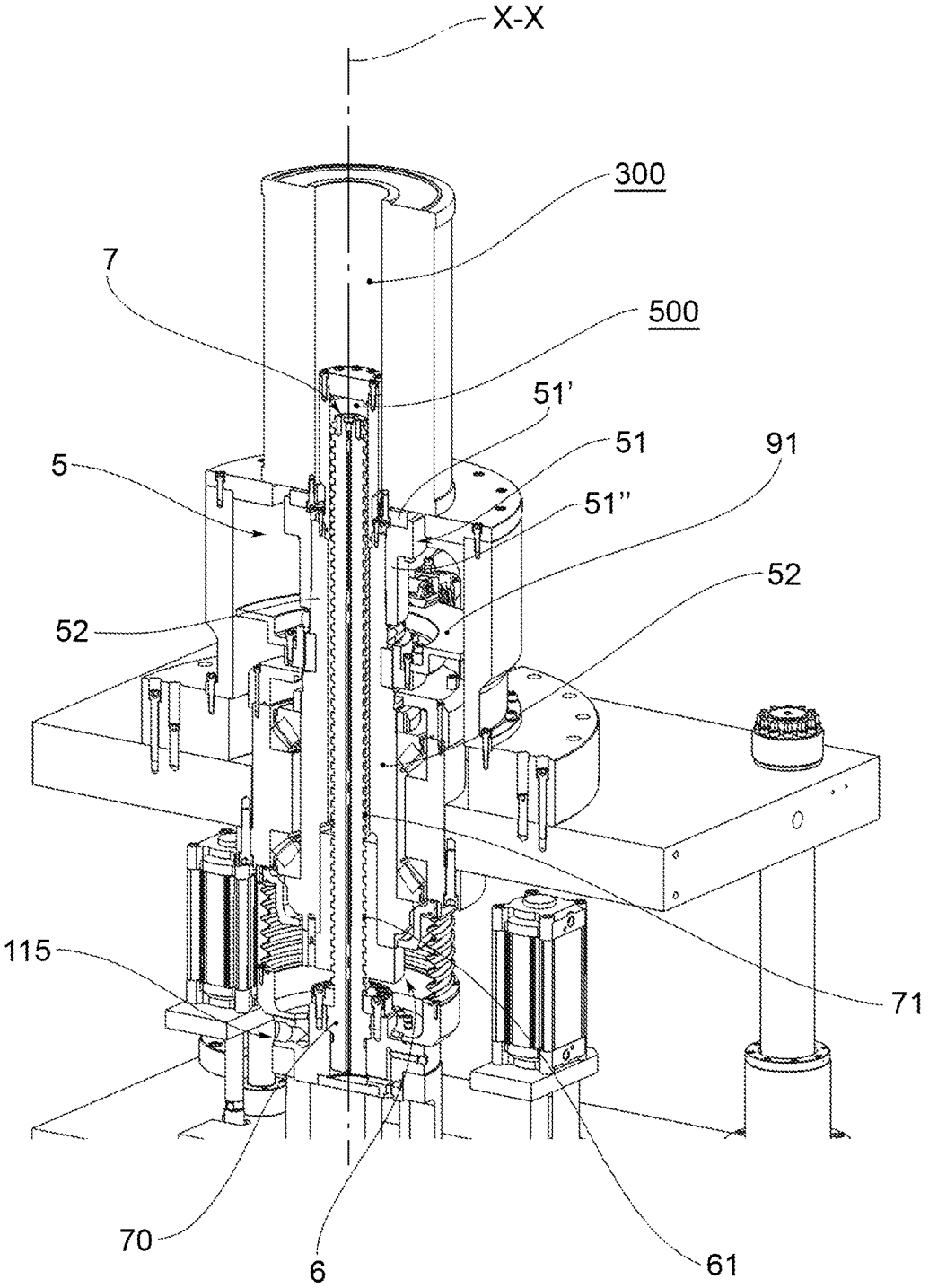
FIG.4"

TRIMMING-DEBURRING ASSEMBLY

CROSS-REFERENCE TO RELATED APPLICATIONS

This application is a National Phase filing of PCT International Application No. PCT/IB2019/054724, having an International Filing Date of Jun. 6, 2019, claiming priority to Italian Patent Application No. 102018000007057, having a filing date of Jul. 10, 2018 each of which is hereby incorporated by reference in its entirety.

FIELD OF THE INVENTION

The present invention relates to a trimming-deburring assembly which performs operations for making a piece from a casting.

In particular, according to the present invention, "casting" is a product obtained through foundry operations. Specifically, casting means a product obtained by gravity, low pressure, or die-casting operations. The casting, therefore, is a "raw product", comprises a series of portions, necessary for the optimal success of the foundry operations that are subsequently to be eliminated: sprues, cast runners, wells, vacuum branches, foundry burrs and/or similar.

Therefore, starting from the casting to obtain a semifinished/worked piece, it is necessary to perform specific operations to eliminate said undesired parts.

In particular, the present invention relates to a technical context in which said casting and the resulting piece are made of a metallic material, preferably a ferrous metal or a non-ferrous metal, for example of light alloy, including an alloy made of aluminum, a brass alloy or a magnesium alloy or a non-ferrous alloy.

BACKGROUND OF THE INVENTION

Plants and machinery known in the prior art as trimming-deburring presses, perform mechanical trimming operations on the casting which involve separation of said portions, thus obtaining a semifinished piece on which to perform further mechanical operations to make it ready for the market.

Specifically, said mechanical operations provide for the execution of cutting operations by means of a trimming-deburring die, in particular said mechanical operations provide for the relative movement of the two die halves which make up the trimming-deburring die. In other words, in the solutions of prior art, the two die halves are mounted on a fixed plane and on a movable plane, in such a way that the movement of the latter involves the movement of the movable die half, housed thereon.

In particular, the known plants and machinery provide hydraulic actuation means which move the movable plane and therefore the movable die half. The hydraulic actuation therefore involves a series of problems linked to management and servicing of the quantities and physical characteristics, such as flow rate, and pressure and temperature of oil.

It is therefore strongly felt to overcome problems linked to hydraulic actuation of the moving planes and the die halves.

SUMMARY OF THE INVENTION

The object of the present invention is to provide a trimming-deburring assembly which meets the aforementioned requirements by falling within the specific context of operations on foundry castings, obviating the aforementioned problems.

Said object is achieved by the trimming-deburring assembly as described and claimed herein. Preferred embodiment variants involving further advantageous aspects are also described.

BRIEF DESCRIPTION OF THE DRAWINGS

The object of the present invention is described in detail hereafter, with reference to the accompanying drawings, in which.

DETAILED DESCRIPTION

Figure 1:
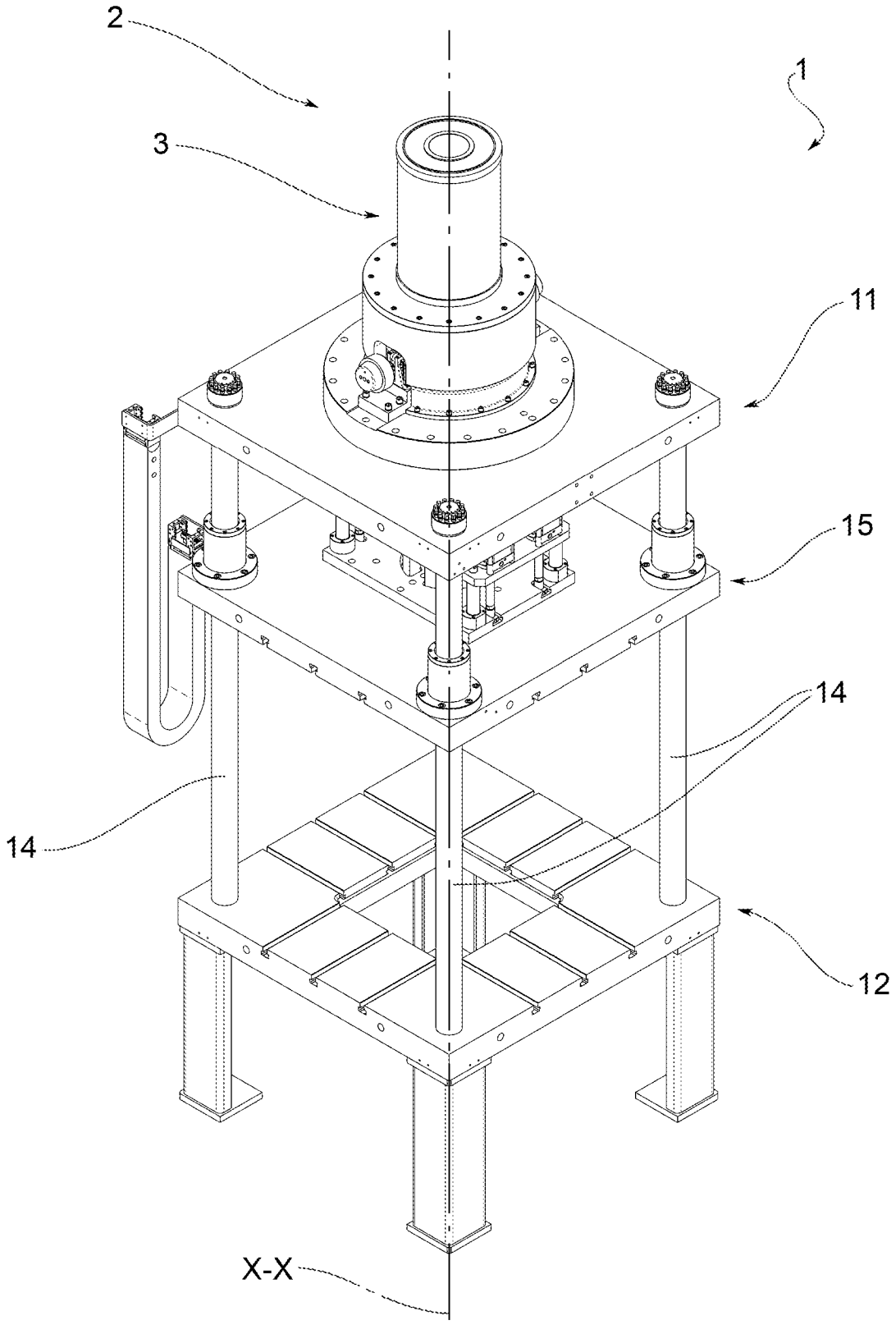
FIG. 1 shows a schematic perspective view of the trimming-deburring assembly of the present invention, according to a preferred embodiment.
Figure 2A:
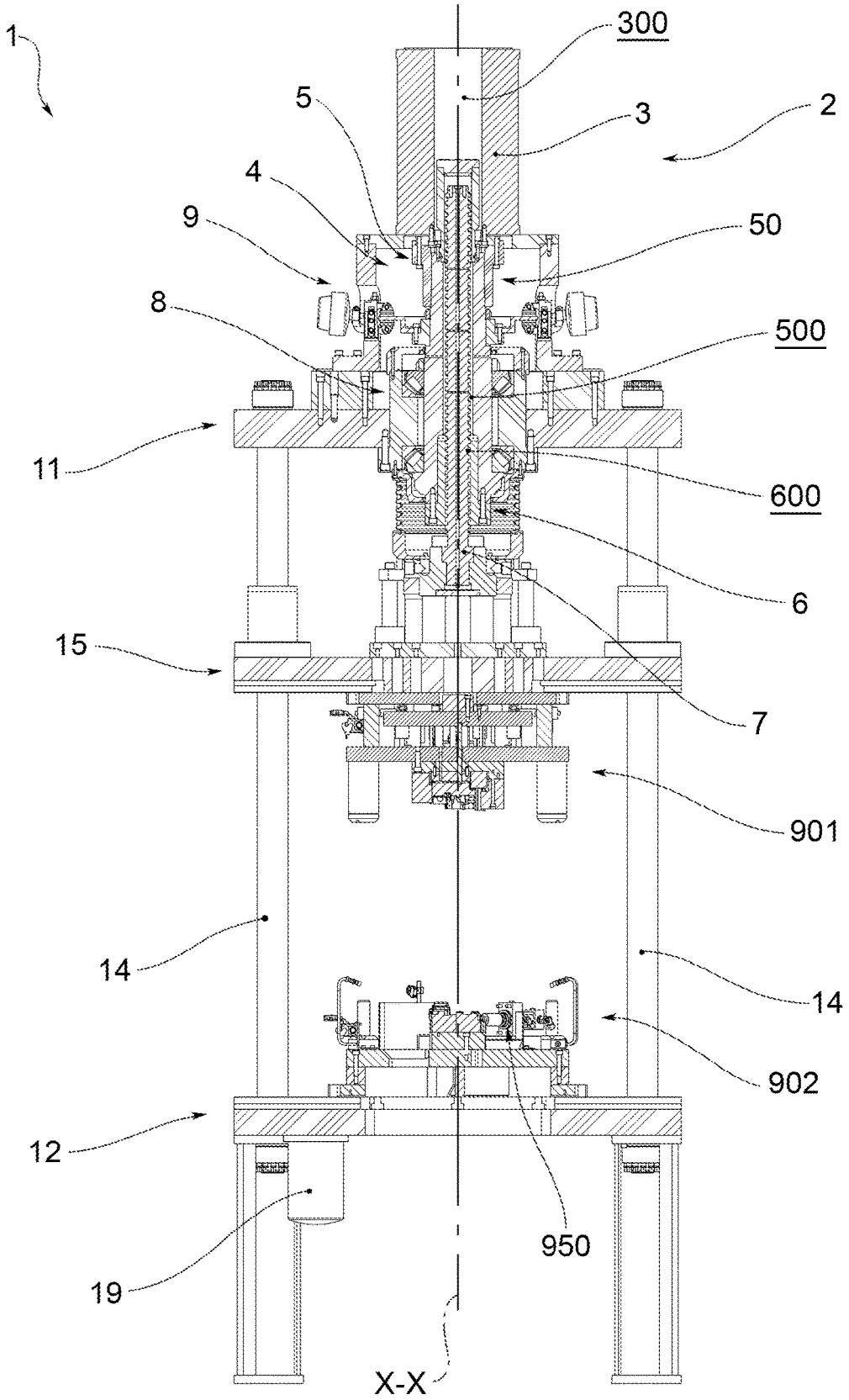
FIGS. 2*a* and 2*b* show two sectional views of the trimming-deburring assembly shown in FIG. 1, housing an example of a trimming-deburring die, with a mobile plate in a raised position and in a lowered position, respectively.
Figure 2B:
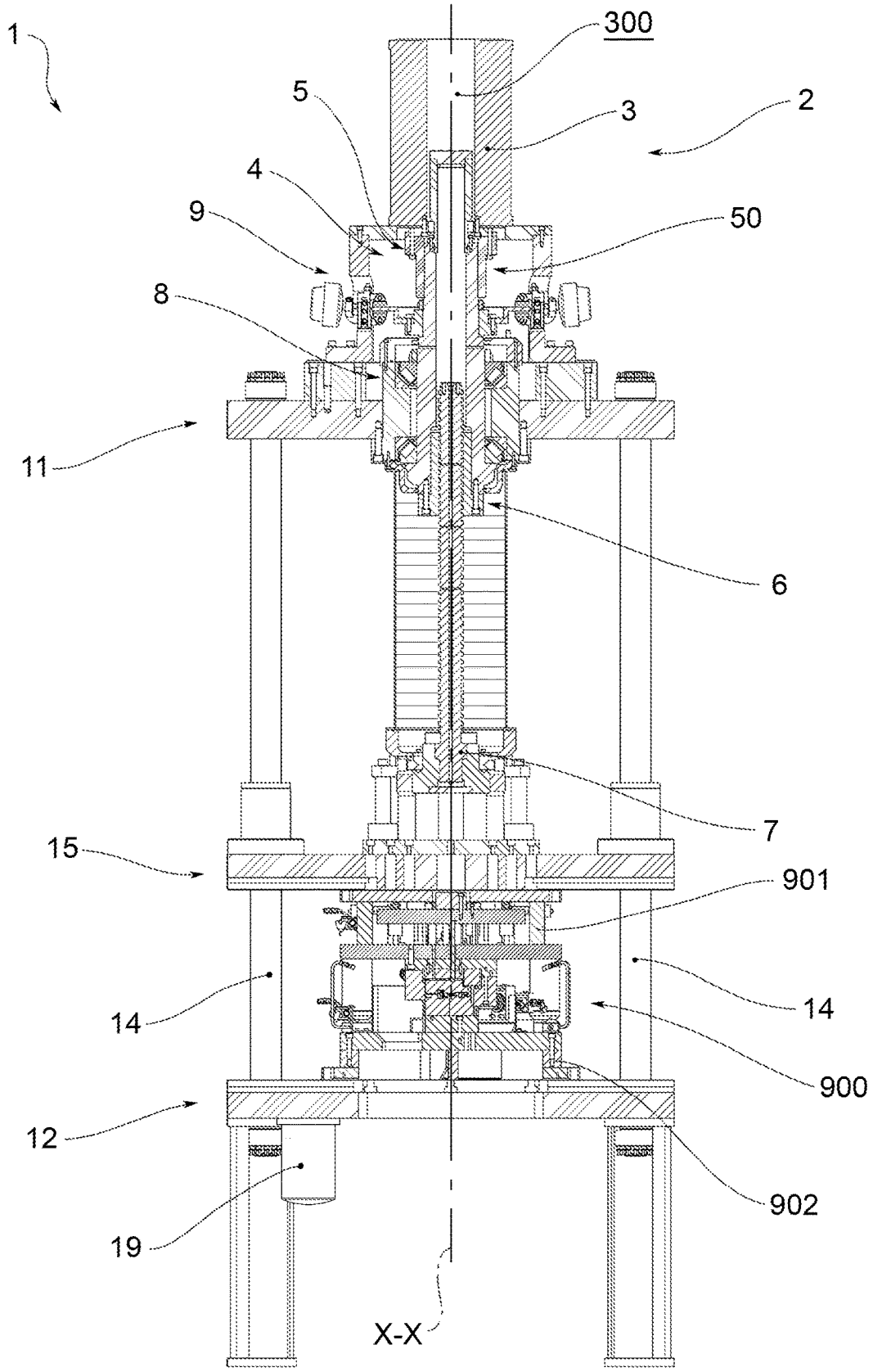
Figure 3:
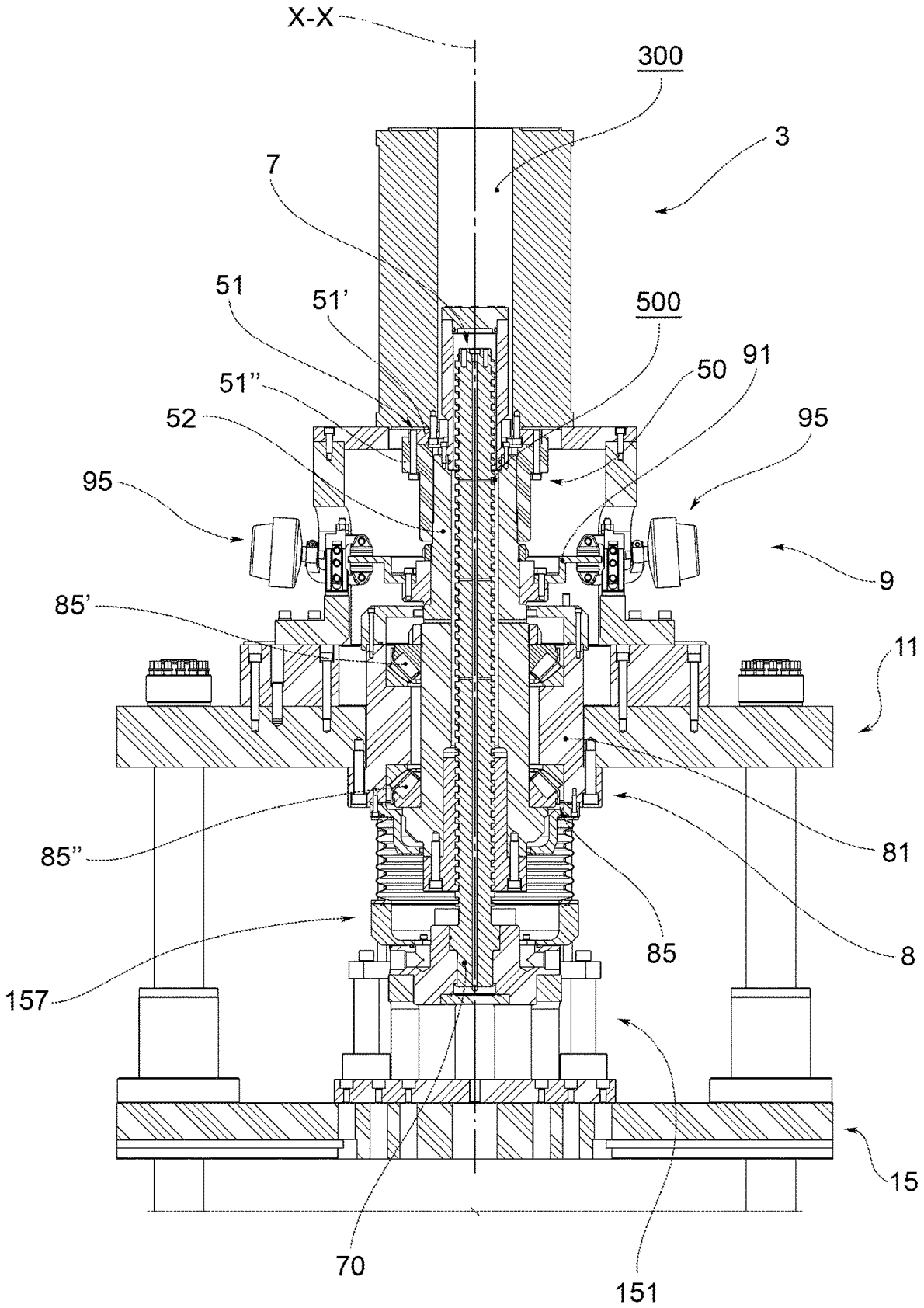
FIG. 3 shows an enlarged view of an upper portion of the trimming-deburring assembly shown in FIG. 2*a;*
Figure 4:
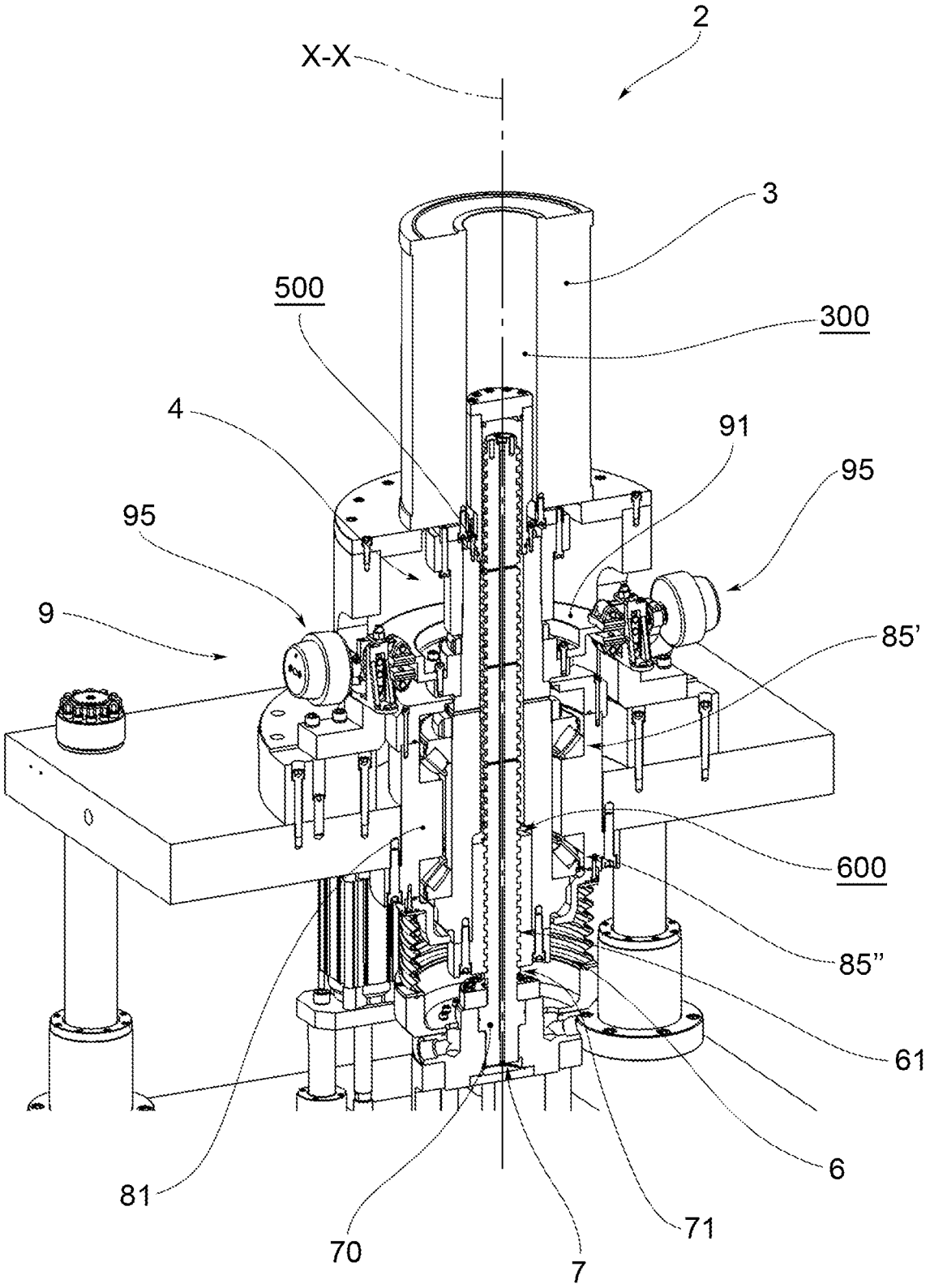
FIGS. 4' and 4" show two perspective views according to different section planes of said upper portion of the trimming-deburring assembly of the preceding figures.

With reference to the above drawings, reference numeral 1 denotes the trimming-deburring assembly of the present invention as a whole. Specifically, the trimming-deburring assembly 1 is suitable for performing operations for manufacturing a piece starting from a casting, performing cutting operations of parts to be discarded from the casting, for example, sprues, cast runners, wells, vacuum branches, foundry burrs and/or similar elements.

In particular, the trimming-deburring assembly 1 of the present invention performs operations by means of a trimming-deburring die 900 which is specially mounted on and moved by the trimming-deburring assembly 1. In particular, the trimming-deburring die 900 comprising an upper movable die half 901 and a lower fixed die half 902.

Specifically, the present invention is not limited in any way to the shape and type of trimming-deburring die 900 and/or die halves.

According to the present invention, the trimming-deburring assembly 1 comprises a plurality of fixed plates (or planes), i.e. having a fixed axial position, and movable, i.e. having an axial position which varies over time according to the configuration in which the trimming-deburring assembly 1 is controlled.

In particular, the trimming-deburring assembly 1 comprises an upper fixed plate 11 and a lower fixed plate 12. The lower fixed die half 902 is housable on said lower fixed plate 12.

Moreover, the trimming-deburring assembly 1 comprises an intermediate mobile plate 15 which is movable in a vertical direction parallel to a main axis X-X. Said mobile plate 15 is axially located in a space between the upper fixed plate 11 and the lower fixed plate 12. The upper mobile die half 901 is housable on said mobile plate 15.

Preferably, said plates are mutually joined by specific support columns 14, for example four, positioned at the four corners of the plates. The lower plate 12 and the upper plate 11 are solidly mounted to said support columns 14, while the mobile plate slides on said columns having specially shaped openings.

According to the present invention, the trimming-deburring assembly 1 comprises command and movement means 2 suitable for moving the mobile plate 15. In other words, the axial position of the mobile plate 15 and of the upper movable die half 901 housed thereon is varied and controlled by said command and movement means 2.

In particular, the command and movement means 2 comprise an electric motor 3 and a movement group 4 operatively connected on top to the electric motor 3 and on the bottom to the intermediate plate 15 suitable for receiving rotary action of the electric motor 3 and converting it into a translational action of the intermediate plate 15.

According to a preferred embodiment, the electric motor 3 is housed on the upper fixed plate 11.

According to some embodiments, the electric motor 3 is located in another place and engages the movement group 4 by means of a specially provided transmission assembly.

In other words, the movement in the axial direction of the movable plate 15 is exclusively electrically operated on command of the electric motor 3 through the movement group 4.

The electric motor 3 is described in detail below, but the movement group 4 is described first.

The movement group 4 comprises a spindle member 5 drivable in rotation about said main axis X-X by the electric motor 3.

Said spindle member 5 comprises a spindle cavity 500 along the main axis X-X and comprises a worm gear element 6 equipped with a worm gear cavity 600 defined by a threaded worm gear wall 61.

According to a preferred embodiment, said spindle member 5 is operatively connected to the electric motor 3 at an upper end thereof and comprises the worm gear element 6 in a lower portion thereof.

Preferably, the worm gear element 6 is axially positioned in a lower position than the spindle member 5, i.e. in a proximal position with respect to the intermediate plane 15.

As illustrated below and as also shown by way of example in the accompanying figures, the spindle member 5 and therefore also the worm gear element 6 comprised therein have a substantially defined and fixed axial position being however free to rotate.

According to the present invention, moreover, the movement group 4 comprises a worm screw element 7 which extends along the main axis X-X comprising a lower end 70 operatively connected to the intermediate mobile plate 15 in such a way that the axial movement of the worm screw element 7 involves the variation of the height of the intermediate mobile plate 15. Preferably, the trimming-deburring assembly 1 further comprises a connecting structure 151 integrally connected to the intermediate mobile plate 15 engageable axially in a rotationally free manner by the end 70 of the worm screw element 7. Preferably, the connecting structure 151 is also suitable for transmitting the localized axial action of the end 70 to a wider portion of the mobile plate 15. According to a preferred embodiment, the connecting structure 151 comprises two mutually axially spaced connection plate-shaped elements (the first engaged to the end 70 and the second to the mobile plate 15) joined together by guiding column elements.

The worm screw element 7 is at least partially housed in the spindle cavity 500 and in the worm gear cavity 600, having a threaded screw wall 71 engaged with the threaded worm gear wall 61 so as to receive the rotary action of the worm gear element 6.

In other words, the threaded screw wall 71 is the "screw" while the threaded worm gear wall 61 is the "nut screw".

According to a preferred embodiment, the threaded screw wall 71 and the threaded worm gear wall 61, specially shaped to complement it, are of the multi-start threaded type.

Preferably, the threaded screw wall 71 and the threaded worm gear wall 61 are two-start type.

Preferably, the threaded screw wall 71 and the threaded worm gear wall 61 have a square pitch.

Preferably, the threaded screw wall 71 and the threaded worm gear wall 61 are "long pitch", for example, they have pitch 50.

According to the present invention, in each axial configuration (i.e. axial height) of the worm screw element 7, the threaded screw wall 71 has a plurality of ridges in engagement on the threaded worm gear wall 61.

Preferably, the threaded screw wall 71 always has ten ridges on engagement on the threaded worm gear wall 61.

According to a preferred embodiment, the spindle member 5 comprises a main hub 50, essentially cylindrical and tubular in shape, engaged on top to the electric motor 3 and on the bottom to the worm gear element 6. In this way, the electric motor 3 controls said main hub 50 in rotation, which by mounting the worm gear element 6 at the lower end thereof, in turn controls it in rotation.

According to a preferred embodiment, the main hub 50 consists of a plurality of components.

Preferably, in fact, the main hub 50 comprises an upper joint 51 directly connected to the electric motor 3 and a spindle shaft 52 directly connected to the worm gear element 6.

According to a preferred embodiment, the upper joint 51 and the spindle shaft 52 are at least partially inserted one into the other along the main axis X-X in such a way that the action of the electric motor 3 at the upper joint 51 is transmitted to the spindle shaft 52. Preferably, the upper joint 51 and the spindle shaft 52 have a substantially cylindrical shape.

According to a preferred embodiment, the upper joint 51 and the spindle shaft 52 are mutually radially engaged with each other by a geometric coupling. For example, the two half-joints have mutually facing walls of complementary shape: in a preferred embodiment, the upper joint 51 and the spindle shaft 52 are geometrically coupled respectively, having protruding portions and housing cavities extending parallel to the main axis X-X. For example, the upper joint 51 and the spindle shaft 52 are geometrically coupled by axial grooves.

In other words, the coupling between the upper joint 51 and the spindle shaft 52 only transmits a rotary action. In fact, no possible actions in the axial direction are transmitted between the upper joint 51 and the spindle shaft 52.

According to a preferred embodiment, therefore, the upper joint 51 is suitable for sliding axially inside the spindle shaft 52.

According to a preferred embodiment, moreover, the upper joint 51 comprises a motor-side half-joint 51', operatively connected to the electric motor 3, and a shaft-side half-joint 51" operatively connected to the spindle shaft 52. Preferably, the motor-side half-joint 51' is substantially a flanged component which can be mounted on the rotor of the electric motor, while the shaft-side half-joint 51" has a hollow cylindrical grooved shape, for housing and engaging the spindle shaft 52 (in turn hollow, housing the spindle cavity 500). Preferably, the motor-side half-joint 51' and the shaft-side half-joint 51" are joined together by screws.

According to a preferred embodiment, the movement group 4 is substantially supported by the upper fixed plate 11. In particular, in fact, the various components described above are supported by said upper fixed plate 11.

According to a preferred embodiment, the spindle member 5 extends in length through the fixed plate 11, i.e. in a through opening specifically provided therein, preferably at the main axis X-X. In this way, the worm gear element 6 and the electric motor 3 are in a lower axial position and in an upper axial position, respectively, with respect to the fixed plane 11.

Preferably, moreover, the movement group 4 comprises a support device 8 suitable for supporting the spindle member 5 on the upper plate 11.

According to a preferred embodiment, the support device 8 comprises a support body 81 fixed to the upper plate 11 and rotation means 85 interposed between the support body 81 and the spindle member 5. By the rotation means 85, the relative rotation of the spindle member with respect to the support body 81 is therefore allowed.

Preferably, the rotation means 85 comprise a couple of bearings 85',85", suitable for supporting and unloading actions in the axial direction and in a radial direction with respect to the main axis X-X on the fixed plate 11, through the support body 81. Preferably, the two bearings 85', 85" are positioned on the two sides of the fixed plate 11 operating in a mutually opposite manner.

According to a preferred embodiment, moreover, the movement group 4 comprises a safety device 9 which engages the spindle member 5 to lock and/or brake the rotating action and therefore the movement of the worm screw element 7.

For example, in fact, the safety device 9 is suitable for intervening to keep the mobile plane 15 in a raised safety position. Preferably, in fact, with the mobile plane 15 raised safely, it is possible to carry out operations to change the die, that is to say, to equip or maintain the die.

According to a preferred embodiment, the safety device 9 comprises a disc element 91 integrally connected to the spindle member 5 in such a way that it rotates therewith, wherein the disc element 91 has a substantially radial extension with respect to the main axis X-X.

Moreover, the safety device 9 comprises at least one gripper device 95 suitable for gripping the disc element 91 to lock and/or brake the rotation thereof.

Preferably, the safety device 9 comprises a plurality of gripper devices 95, for example two, mutually angularly equidistant with respect to the main axis X-X.

According to a preferred embodiment, the spindle member 5 in the spindle cavity 500 is suitable for containing a lubricating element suitable for lubricating the movement of the worm screw element 7 with the worm gear element 6. In other words, the same spindle member 5, in particular in the spindle cavity 500, acts as a lubricant storage. Preferably, the same worm screw element 7 comprises suitable ducts which allow the passage of the lubricant so as to keep the entire threaded screw wall 71 and also the threaded worm gear wall 61 lubricated. In addition, according to a preferred embodiment at the lower end 70, preferably at the connection structure 151, there is a lubricant collection body 157 suitable for collecting a predefined quantity of lubricant at the bottom.

According to a preferred embodiment, the electric motor 3 is of the hollow type. The electric motor 3 therefore comprises a motor cavity 300 which extends along the main axis X-X.

Preferably, in said motor cavity 300, the movement group 4, and in particular the worm screw element 7 and/or the spindle member 5 are at least partially housed.

According to a preferred embodiment, the electric motor 3 is of the internal rotor type. Preferably, therefore, the spindle member 5, in particular the upper joint 51, in particular the motor-side half-joint 51', are integrally connected with said internal rotor to rotate simultaneously therewith.

Preferably, the electric motor 3 is of the direct torque type, and therefore does not require a reducer to transmit the motion to the movement group 4.

According to a preferred embodiment, moreover, the electric motor 3 accumulates energy in the descent operations of the mobile plate 15 and uses said stored energy to perform the ascending operations of the mobile plate 15 upwards. Preferably, the accumulated energy can also be used for other members or components of the trimming-deburring assembly 1 or it can be used as an electrical supply for other components external to the trimming-deburring assembly 1.

According to a preferred embodiment, in the descending operations the electric motor 3 starts at the moment of the start of the movement starting from a configuration with mobile plate 15 in a raised position, while the rest of the descent is due to the mass of the upper movable die half 901 and of the mobile plate 15, thus taking place by inertia. In addition, according to a preferred embodiment, the electric motor 3 also intervenes in the final steps of the axial descent movement corresponding to the trimming of the casting. In other words, the electric motor intervenes only when the power supply is exclusively necessary.

Furthermore, according to a preferred embodiment, in which the upper movable die half 901 and/or the lower fixed die half 902 comprise at least one radial die carriage 950, the trimming-deburring assembly 1 comprises a pneumatic supply device 19 of said radial die carriage 950.

According to a preferred embodiment, said pneumatic supply device 19 is housed on the mobile plate 15 and/or on the lower fixed plate 12.

According to a preferred embodiment, the pneumatic supply device 19 comprises an apparatus for multiplying pressure of the compressed air, for example suitable for bringing the air under pressure up to 30/40 bar (or 3/4 kPa).

Innovatively, the trimming-deburring assembly 1 is suitable for fully fulfilling the intended purpose.

Advantageously, the trimming-deburring assembly overcomes the problems related to the hydraulic movement of the components by presenting an innovative mode of electric only movement.

Advantageously, the trimming-deburring assembly is suitable for accumulating electrical energy by exploiting the inertia of the descent operations.

Advantageously, the trimming-deburring assembly operates with a high energy saving with respect to the known solutions. In particular it performs a high energy saving also with reference to the hydraulically operated solutions in which it is anyway necessary to supply electricity to control the hydraulic plant.

Advantageously, the trimming-deburring assembly manages energy consumption in such a way as to limit the power supply of the electric motor only and exclusively to the steps in which it is necessary.

Advantageously, the trimming-deburring assembly does not require particular maintenance operations.

Advantageously, the trimming-deburring assembly is particularly clean from circuit-breakers and accessory systems, for example hydraulic systems. Advantageously, the trimming-deburring assembly appears to have a particularly clean operating area and not, for example, dirty from oils or oil residues as instead present in the known solutions of the hydraulic actuation of prior art.

Advantageously, the mutual engagement between the worm screw element and the worm gear element allows relatively high axial translations corresponding to relatively short reciprocal rotations.

Advantageously, the trimming-deburring assembly is designed in such a way as to be compact and contained.

Advantageously, the trimming-deburring assembly is designed in such a way as to be particularly rigid.

Advantageously, the trimming-deburring assembly can be designed according to the powers that it must deliver. In particular, the electric motor and above all the components included in the movement group, in particular the worm screw element, can be designed according to the needs and to the tonnage to be expressed for trimming-deburring operations.

Advantageously, the trimming-deburring assembly operates in total safety for the people who use it, for example maintenance personnel and/or the toolmakers. Advantageously, the trimming-deburring assembly operates in total safety for the components that compose it (i.e. the work screw element, the worm gear element) or that are housed therein (i.e. trimming-deburring dies).

Advantageously, the trimming-deburring assembly is free from all the elements necessary for hydraulic movement, such as pump units, series of solenoid valves, oil cooling units, relative circuitry.

A person skilled in the art may make several modifications or replacements of elements with other functionally equivalent ones to the embodiments of the above trimming-deburring assembly in order to meet specific needs without however departing from the scope of protection as described and claimed herein.

Moreover, each variant described as belonging to a possible embodiment may be implemented independently of the other variants described.

The invention claimed is:

1. A trimming-deburring assembly for making a piece from a casting by performing cutting operations of parts to be discarded from the casting, using a trimming-deburring die comprising an upper movable die half and a lower fixed die half, wherein the trimming-deburring assembly comprises:

an upper fixed plate;

a lower fixed plate, the lower fixed die half is being housable on the lower fixed plate;

an intermediate mobile plate, movable between the upper fixed plate and the lower fixed plate, in a vertical direction parallel to a main axis (X-X), wherein the upper mobile die half is housable on said intermediate mobile plate;

command and movement means suitable for moving the intermediate mobile plate, comprising:

an electric motor housed on the upper fixed plate;

a movement group operatively connected on top to the electric motor and on the bottom to the intermediate mobile plate, comprising:

a spindle member drivable in rotation about said main axis (X-X) by the electric motor, comprising a spindle cavity along the main axis (X-X) and a worm gear element equipped with a worm gear cavity defined by a threaded worm gear wall; and a worm screw element extending along the main axis (X-X), at least partially housed in the spindle cavity and the worm gear cavity, comprising a threaded screw wall engaged with the threaded worm gear wall and a lower end operatively connected to the intermediate mobile plate in such a way that rotation of the worm gear element involves an axial movement of the worm screw element and in turn a change in height of the intermediate mobile plate.

2. The trimming-deburring assembly of claim 1, wherein the threaded screw wall and the threaded worm gear wall, shaped to complement the threaded screw wall, are of the multi-start threaded type.

3. The trimming-deburring assembly of claim 2, wherein the threaded screw wall and the threaded worm gear wall are double-start, having a square pitch.

4. The trimming-deburring assembly of claim 2, wherein, in each axial configuration of the worm screw element, the threaded screw wall has a plurality of ridges in engagement on the threaded worm gear wall.

5. The trimming-deburring assembly of claim 4, wherein, in each axial configuration of the worm screw element, the threaded screw wall has at least ten ridges always in engagement on the threaded worm gear wall.

6. The trimming-deburring assembly of claim 1, wherein the electric motor is of the hollow type comprising a motor cavity extending along the main axis (X-X) in which the movement group, and preferably the worm screw element are at least partly housed.

7. The trimming-deburring assembly of claim 6, wherein the electric motor comprises an internal rotor in such a way that the spindle member is integrally connected to said internal rotor to rotate simultaneously therewith.

8. The trimming-deburring assembly of claim 1, wherein the electric motor accumulates energy in descent operations of the intermediate mobile plate and uses the accumulated energy to perform ascending operations of the intermediate mobile plate.

9. The trimming-deburring assembly of claim 1, wherein the spindle member comprises a main hub, cylindrical and tubular in shape, engaged on top to the electric motor and on the bottom to the worm gear element.

10. The trimming-deburring assembly of claim 9, wherein the main hub comprises an upper joint, directly connected to the electric motor, and a spindle shaft, directly connected to the worm gear element, wherein the upper joint and the spindle shaft are at least partially inserted one inside the other along the main axis (X-X) and radially engaged with each other by a geometric coupling, so that an exclusively rotary action is transmitted between the upper joint and the spindle shaft.

11. The trimming-deburring assembly of claim 1, wherein the spindle member extends in length through the upper fixed plate, so as to present the worm gear element and the electric motor respectively in a lower axial position and in an upper axial position with respect to the upper fixed plate.

12. The trimming-deburring assembly of claim 11, wherein the movement group comprises a support device suitable for supporting the spindle member on the upper fixed plate, wherein the support device comprises a support body fixed to the upper fixed plate and rotation means interposed between the support body and the spindle member.

13. The trimming-deburring assembly of claim 12, wherein the rotation means comprise a couple of bearings positioned on both sides of the upper fixed plate, suitable for supporting and unloading actions an axial direction and a radial direction with respect to the main axis (X-X) on said upper fixed plate.

14. The trimming-deburring assembly of claim 1, wherein the movement group further comprises a safety device which engages the spindle member to lock and/or brake rotating action and therefore movement of the worm screw element.

15. The trimming-deburring assembly of claim 14, wherein the safety device comprises:

a disc element integrally connected to the spindle member so as to rotate therewith, wherein the disc element has a substantially radial extension with respect to the main axis (X-X); and at least one gripper device suitable for gripping the disc element to lock and/or brake rotation thereof.

16. The trimming-deburring assembly of claim 1, wherein the worm gear element is axially positioned in a lower position than the spindle member, and in a proximal position with respect to the intermediate mobile plate.

17. The trimming-deburring assembly of claim 1, wherein the spindle member in the spindle cavity is suitable for containing a lubricating element suitable for lubricating movement of the worm screw element with the worm gear element.

18. The trimming-deburring assembly of claim 1, further comprising a connecting structure integrally connected to the intermediate mobile plate axially engageable in a rotationally free manner by the lower end of the worm screw element.

19. The trimming-deburring assembly of claim 1, wherein the upper mobile die half and/or lower fixed die half comprises at least one radial die carriage, wherein the trimming-deburring assembly comprises, housed on the intermediate mobile plate and/or lower fixed plate, a pneumatic supply device of said at least one radial die carriage comprising an apparatus for multiplying compressed air pressure.

* * * * *